US006223487B1

(12) United States Patent
Dinkel

(10) Patent No.: US 6,223,487 B1
(45) Date of Patent: May 1, 2001

(54) CONCRETE CONSTRUCTION MODULES FOR BUILDING FOUNDATIONS AND WALLS

(75) Inventor: Frederick Thomas Dinkel, Cottage Grove, WI (US)

(73) Assignee: Innovative Foundations, LLC, Maison, WI (US)

( * ) Notice: Subject to any disclaimer, the term of this patent is extended or adjusted under 35 U.S.C. 154(b) by 0 days.

(21) Appl. No.: 09/413,708

(22) Filed: Oct. 6, 1999

Related U.S. Application Data

(60) Provisional application No. 60/103,167, filed on Oct. 6, 1998.

(51) Int. Cl.[7] ..... E04C 5/16

(52) U.S. Cl. ..... 52/285.1; 52/223.7; 52/223.6; 52/223.14; 52/223.13; 52/795

(58) Field of Search ..... 52/286, 254, 223.7, 52/295, 223.6, 223.14, 293.2, 590.1, 590.3, 591.1, 592.4, 604, 606, 607, 223.9, 223.1, 223.13

(56) References Cited

U.S. PATENT DOCUMENTS

| | | | | |
|---|---|---|---|---|
| 738,643 | * | 9/1903 | Camp | 52/605 |
| 1,500,377 | * | 7/1924 | Dodson | 52/592.1 X |
| 1,704,255 | * | 3/1929 | Lewis | 52/286 X |
| 2,038,615 | * | 4/1936 | Underdown | 52/585 |
| 2,413,990 | * | 1/1947 | Muntz | 52/605 |
| 2,644,497 | * | 7/1953 | Wilmer et al. | 52/585 |
| 2,877,506 | * | 3/1959 | Almoslino | 20/5 |
| 3,503,165 | * | 3/1970 | Hardt | 52/592.1 X |

(List continued on next page.)

FOREIGN PATENT DOCUMENTS

144378 * 6/1920 (GB) ..... 52/607

OTHER PUBLICATIONS

Details on Thermal–Krete precast foundation systems from: http://www.kistner.com/thermal/thermal, 8 pages, publication date unknown.

Details on Thermomass precast foundation systems from: http://www.thermomass.com, 5 pages, publication date unknown.

Details on Weaver Precast, Inc. precast foundation systems from: http://www.weaverprecast.com/product_info.html, 3 pages, publication date unknown.

Details on Superior Walls of America, Ltd. precast basement foundations systems from: http://www.superiorwalls.com, 7 pages, publication date unknown.

Details on Royall Wall Systems, Inc. precast foundation systems from:http://www.royallwall.com, 4 pages, publication date unknown.

The Wide World of Flatwallers, PBF Magazine, May 15, 1999, 4 pages.

*Primary Examiner*—Carl D. Friedman
*Assistant Examiner*—Phi Dieu Tran A
(74) *Attorney, Agent, or Firm*—Craig A. Fieschko, Esq.; DeWitt Ross & Stevens S.C.

(57) ABSTRACT

Construction modules made of concrete or other cementitious materials, as well as walls made from such modules, are shown and described. The modules bear internal passages through which cables, rods, or other elongated members may be extended. The members may then be tensioned to affix the modules together, and also to place the individual modules in compression and thereby enhance their strength. The tensioning members can be anchored to the members at opposing ends of a wall, and/or they may be affixed inside the passages within the members by flooding the passages with cement, grout, or other suitable adhesive materials. The modules may be formed with insulation, electrical boxes/wiring, furring strips, and other such features so that these features will be pre-installed when the modules are assembled into a wall.

19 Claims, 2 Drawing Sheets

U.S. PATENT DOCUMENTS

| | | | | |
|---|---|---|---|---|
| 3,798,860 | | 3/1974 | Mason . | |
| 3,908,324 | * | 9/1975 | Stout | 52/607 X |
| 4,161,089 | | 7/1979 | Omansky . | |
| 4,207,718 | * | 6/1980 | Schaaf et al. | 52/585 |
| 4,227,829 | * | 10/1980 | Landry, Jr. | 405/20 |
| 4,294,051 | | 10/1981 | Hughes, Jr. . | |
| 4,324,037 | * | 4/1982 | Grady, II | 29/469 |
| 4,357,784 | | 11/1982 | Grady, II . | |
| 4,375,928 | | 3/1983 | Crow et al. . | |
| 4,805,366 | | 2/1989 | Long . | |
| 4,829,733 | | 5/1989 | Long . | |
| 5,065,558 | | 11/1991 | Boatsman . | |
| 5,065,560 | | 11/1991 | Yodër . | |
| 5,103,613 | | 4/1992 | Kinoshita . | |
| 5,159,791 | | 11/1992 | Juhas . | |
| 5,484,230 | | 1/1996 | Rudloff . | |
| 5,622,456 | * | 4/1997 | Risi et al. | 405/284 |
| 5,671,574 | | 9/1997 | Long . | |
| 5,798,067 | | 8/1998 | Long, Sr. . | |
| 5,820,299 | * | 10/1998 | Anderson | 405/172 |
| 5,899,040 | * | 5/1999 | Cerrato | 52/604 |

* cited by examiner

CONCRETE CONSTRUCTION MODULES FOR BUILDING FOUNDATIONS AND WALLS

CROSS-REFERENCE TO RELATED APPLICATIONS

This application claims priority under 35 USC §119(e) to U.S. Provisional Patent Application 60/103,167 filed Oct. 6, 1998, the entirety of which is incorporated by reference herein.

FIELD OF THE INVENTION

This disclosure concerns an invention relating generally to construction of building foundations, and more specifically to construction of building foundations and walls using modular components.

BACKGROUND OF THE INVENTION

In current construction practice, foundations for buildings are commonly formed by digging a foundation hole, assembling forms within the hole to effectively form a mold, pouring concrete within the assembled forms, and then removing the forms when the concrete has set into a solid form. The foundation is then left standing in the foundation hole, which is backfilled around the exterior of the foundation. The remainder of the building is then constructed atop the poured foundation. As a result of this process, construction of a building is highly dependent on the proper completion of its foundation. This can lead to difficulties in areas wherein soil conditions delay or hinder the digging of the foundation hole, and wherein the climate is not agreeable to pouring of concrete owing to rain or freezing. Rain causes significant difficulties insofar as concrete mixing trucks must generally be driven on-site in order to pour the concrete within the forms, and muddy sites can make this effectively impossible; the heavy trucks can get stuck in the mud, preventing them from reaching the pouring location. Freezing causes difficulties because it interferes with the setting/curing of concrete, and it can effectively ruin freshly poured concrete.

Further difficulties with properly forming a foundation are inherent in the pouring process. Because foundation walls must be poured within vertically-oriented forms/molds, the concrete mix must be in a substantially fluid state if it is to readily flow within the forms to fill out all corners, prevent voids, etc. However, in order for the concrete mix to reach this degree of fluidity (i.e., a low "slump" value), a substantial amount of water must be used in the concrete mix. This results in weaker, lower-density concrete, with greater permeability to water after setting occurs. Further, a watery concrete mix results in longer concrete setting/curing times. This slows building construction because backfilling against a newly-poured foundation before it is fully set may cause the foundation walls to collapse, or may crack them to later allow water to enter the foundation.

SUMMARY OF THE INVENTION

The invention, which is defined by the claims set out at the end of this disclosure, is directed to wall modules made of concrete or other cementitious materials, and building walls made of such modules. To briefly summarize the invention, reference will be made to the accompanying drawings.

As illustrated in FIG. 1, building walls can be constructed of a series of wall modules situated end-to-end in the form of a vertical wall. Each module includes an internal passage, and a tensioning member (e.g., a cable or rod) is strung through the passages of adjacent modules, tensioned, and then anchored within the passages. This pulls the collective modules together to form a rigid wall, and also places each individual module in compression, thereby increasing its strength. Such tensioning can occur by anchoring the ends of the tensioning members at the opposing ends of the wall, and/or by applying an adhesive material within the passages which bonds the tensioning member to the passage walls after it is tensioned. A preferred method of applying the adhesive material is to provide the modules with bore holes which extend from the inner or outer wall surfaces to open upon the passages, thereby allowing cement, grout, or similar adhesives to be poured or pumped within the bore holes to fill the passages about the tensioning members. When the adhesive dries, the tensioning member will be fixed in tension within each module, placing the module in compression and increasing its strength.

Since it will generally be desirable to have the building wall be draft- and water-resistant—particularly if the wall is used in a building foundation—additional features can be incorporated to prevent the elements from entering. The abutting ends of the modules may be treated with tar, cement or other adhesives before placing them together so that the ends are effectively affixed, and/or the joints can be externally coated with paraffin, tar, or other sealants. The ends of the modules at the joints can be configured so as to provide a longer entry path for air or water, thereby deterring its entry; for example, the abutting module ends can be configured as in FIG. 3, wherein a protrusion extending along the end of one module is received within a recess in the adjacent module. The entry of water is further deterred by providing a vertical channel within the joint (as exemplified by the channels 1604 within the joint of FIG. 3) so that water entering the joint will encounter the channel, and will then flow downwardly to be received by a drainage system.

During their initial formation, the modules can incorporate a wide variety of features which would otherwise require additional installation steps later. As examples, the modules can include built-in insulation, furring strips, electrical boxes, sill plates, etc. By pre-forming the modules with these features off-site, significant time savings is achieved on-site because building walls will be close to finished form immediately after they are constructed.

The modular concrete foundation system noted above is believed to provide numerous significant advantages over standard poured concrete foundations.

First, it is believed to provide strength superior to that of poured concrete foundations. This is primarily believed to occur because the tensioning members exert a compressive force on the modules and increase their strength over that provided when they are in an uncompressed state.

Second, it is believed that foundations formed by the invention, while formed in modular sections, can actually provide greater resistance to water entry than "single-piece" poured foundations. Poured foundations are highly susceptible to cracking somewhere along their lengths, whereas the modules of the present invention are smaller and less susceptible to stress cracking. Further, the modules will alleviate stress by flexing at the joints between abutting modules. Provided these joints have been waterproofed by means of a sealant/adhesive (e.g., tar), water is unlikely to enter.

Third, by preforming modules in bulk and installing them on-site, installation of a foundation is made much less expensive and time-consuming than the prior method of installing forms, pouring concrete, and allowing it to cure before continuing construction. Poured foundations require that the entire foundation be poured in a short time period to avoid setting of concrete within the mixer and disparate setting times in the foundation, and it is difficult to precisely obtain desired dimensions across the entire foundation. By using smaller molds, as with the modules of the invention, concrete may be mixed in smaller batches and uniform dimensions are much more easily obtained. Further, the modules of the invention provide substantial time savings by allowing pre-installation of studs, furring strips, lintels, sill plates, insulating sections, etc. within the modules. In addition, since modules may be poured in moderate climates, climate-controlled warehouses, or other locations where rain and freezing does not interfere with proper concrete pouring and curing, inclement weather is no longer an obstacle to construction.

Fourth, significant advantages are obtained owing to the fact that the modules may be cast by horizontal pouring (i.e., pouring wherein both the modules and their molds are primarily oriented parallel to the ground), rather than by the vertical pouring used with standard foundations. When foundations are vertically poured between forms, it is difficult to obtain uniform and level height across the entire foundation. As noted above, uniform dimensions are easily obtained when modules are horizontally poured in molds. Further, the ability to obtain interior or exterior finishing of foundation walls—for example, a brick-like texture—is for all practical purposes impossible within foundations poured into vertical forms. In contrast, this is easily achieved within horizontally-oriented molds since these can simply have their top or bottom surfaces form the appropriate texture into the modules.

Fifth, numerous difficulties involved with on-site concrete pouring are eliminated. As an example, it is not uncommon for concrete mixing trucks to become bogged down and stuck within wet construction sites for a week or more out of the construction season when they drive in to pour a foundation. This may result in halted construction until the truck is freed because the truck is generally not properly positioned for pouring the foundation, and continued construction may depend on the presence of a foundation. Since the present invention eliminates the need for a concrete mixing truck at the construction site, site conditions will no longer hinder or halt construction progress. The need for a crane or similar equipment for lifting and placing modules on-site is not disadvantageous; unlike concrete mixers, cranes are sometimes mounted on caterpillar treads which allow them to move on muddy ground, and additionally any crane of reasonable size can be situated away from muddy areas (e.g., on streets or driveways adjacent to a building site) and can still lift and place modules.

Sixth, modules formed of poured cementitious materials can readily accommodate different forms of decorative surface treatment prior to the time they have cured/set. As an example, a poured concrete module can be provided with a simple swept surface; pea gravel may be poured upon the wet module surface to provide a textured surface; concrete stencils can be used to give the wet surface a brick-and-mortar or mortared stone appearance; and colored dust or paint can be applied to color the concrete. By providing these decorative surfaces in the modules during or immediately after their formation, the decorative surfaces are far more durable than they would be if added afterwards.

Seventh, when walls are constructed from modules in accordance with the invention, substantial time savings is attained because backfilling can occur about a wall as soon as its modules are tensioned (and assuming that the wall is anchored against tipping or sliding in the direction of backfilling, as will occur if the wall is adjoined by one or more perpendicular walls). Since the tensioning members minimize their tension by remaining as straight as possible, they will tend to line up the modules so that their passages are collinearly aligned, and they therefore prevent buckling of a wall about the joints between modules. In contrast, if modules are simply connected by affixing them together only near their joint regions, the joints are subject to much higher stress because forces acting on the centers of the modules translate to high moment or "lever stress" on the joints. This can result in buckling of walls at the joints when backfilling occurs unless the wall is somehow reinforced, e.g., by pouring a floor adjacent the wall and/or at least partially constructing a building frame atop the wall. While it is true that both of these reinforcement measures must generally be performed during construction in any case, they are often made much more difficult if backfilling must occur after these measures are performed rather than beforehand.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
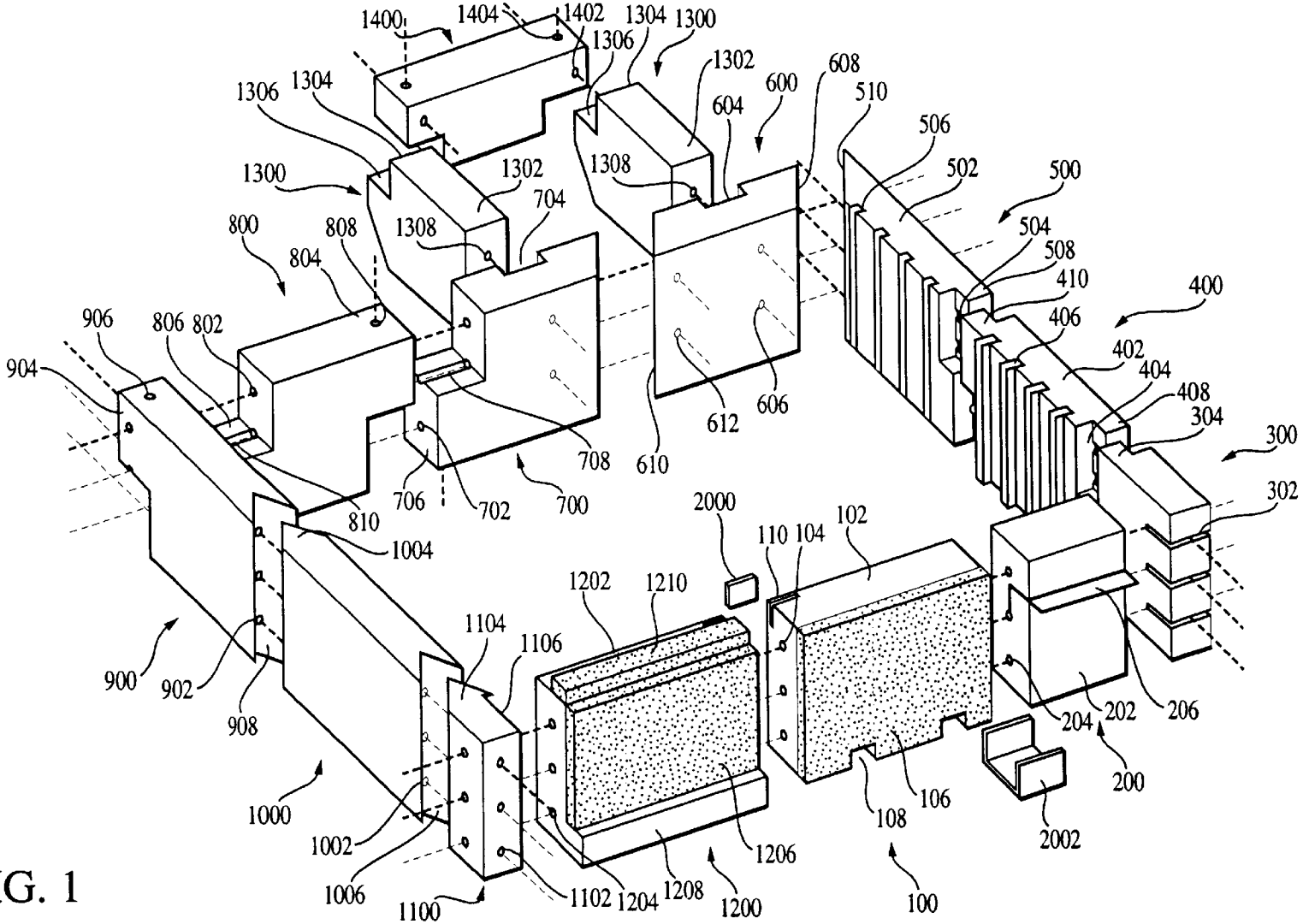
FIG. 1 is a perspective view of an exemplary modular concrete foundation formed in accordance with the present invention.

Referring to FIG. 1, which illustrates a modular building foundation in an exploded perspective view, exemplary embodiments of foundation modules are illustrated and are designated by the reference numerals 100, 200, 300, 400, 500, 600, 700, 800, 900, 1000, 1100, 1200, and 1300. These modules are inserted, e.g., by a crane, into an excavated building foundation hole and into a configuration which closely resembles that of a poured concrete building foundation. The modules are then affixed together for rigidity to allow them to serve as a building foundation which is completed by pouring or otherwise adding a floor. Before describing each of these modules, several common characteristics of the modules will first be described.

First, the modules will generally have the same thickness as a standard concrete foundation wall, e.g., 6–12 inches, and may be configured to have any desired height and length. Generally, the height will be that of a standard concrete foundation wall, e.g., 7–14 feet. Otherwise, the modules are formed with any desired length; in general, it is expected that the length of any module will not exceed 28 feet for ease of transportation and handling, and to reduce the possibility of cracking. However, it is noted that these exemplary thickness, height, and length measurements are provided in order to enable the reader to better visualize the modules, and in reality the module dimensions may vary widely to suit the particular application at hand in which the modules are to be used. It is expected that in most applications, adjacent modules will generally have the same height and width, but variations in length between different modules will be relatively common.

Second, each of these modules is intended to include a cast section which is formed of concrete or other cementitious materials. Since there has been increasing interest in recent years in "alternative" or "renewable" building materials, it is noted that materials other than concrete may be used, such as adobe, composite materials formed of waste products, etc. However, since concrete is expected to be the most economical material for use in the cast sections for the foreseeable future, this specification will generally refer to the cast sections as being made of concrete. Where concrete is used for the cast sections, a cast section is preferably formed by pouring the concrete into an appropriately-configured mold. Since such pouring may occur with at least a major portion of the cast section and its mold resting parallel to the ground—i.e., it may be "horizontally poured"—formation of the cast section is substantially easier than the "vertical pouring" that must occur in standard concrete foundations, wherein tall, vertically-oriented forms are arrayed in parallel fashion and concrete is poured between the forms.

Third, each of these modules includes at least one passage which extends through at least one of the length, width, or height dimensions of the module. These passages may be formed in a variety of different ways. One way in which they may be formed is by inserting tubes made of metal, plastic, cardboard, or other materials within the molds wherein the cast sections of the modules are poured and cured, so that these tubes serve as the passages. Alternatively, the passages may be formed by inserting rods within the molds and then regularly rotating and/or reciprocating these rods as the concrete cures around them. The concrete will never solidly adhere to the rods provided they are moved frequently enough, and the rods may then be withdrawn after the concrete is substantially cured to leave passages within the cast sections.

Fourth, once the modules are inserted within the foundation hole, they are intended to be fixed together by means of tensioning members (e.g., cables or rods) which are extended through the passages in the modules, and which are then tensioned and anchored so as to draw the modules tightly together. In the drawings, the paths of the tensioning members are illustrated by dashed lines. Where appropriate, waterproofing sealants (e.g., tar or hardening polymeric foams), adhesives, or other materials may be applied to the abutment points of the modules prior to tensioning them together.

Different forms of tensioning members may be used, and in abutting modules wherein their adjacent passages form a generally straight path, threaded rod (or rod having threaded ends) is particularly preferred. Its relative rigidity allows it to be easily strung within the passages, and tensioning is easily achieved by screwing nuts on the opposing ends of the rod until the nuts engage the modules from which the rods protrude. In the embodiment of the invention shown in FIG. 1, tensioning may best be imagined by visualizing threaded rod having a 1-inch diameter extending through the passages in the modules, and having ends slightly protruding from the terminal modules to accommodate nuts once the modules are drawn closely together in abutting fashion. Instead of (or in addition to) rods, cable may be strung within the passages of abutting modules, may be tensioned, and may then be anchored at its protruding ends to serve as a tensioning member. Cable strung through abutting modules may also be provided with screw eyelets at its ends, and nuts may be screwed onto the eyelets to provide tension in a manner similar to that of threaded rods. Cable is particularly useful as a tensioning member because it is relatively easily extended over longer distances, or around corners.

Naturally, tensioning will not occur by use of nuts unless the nuts are sufficiently sized that they bear against the modules at the passage entrances, that is, so that they do not fit within the passages. Where nuts are insufficiently sized, washer-like plates (or other structures) may be provided at the passage entrances, and these plates may bear apertures which can accommodate the passage of the tensioning members but not their nuts. Such plates are recommended even where nuts (or other anchors) would by themselves maintain the tensioning members in tension within the modules; such plates, where provided, will be pulled inwardly to apply compressive force over a larger area of the modules adjacent the passage entrances, and this is believed to make the modules stronger. In the embodiment of the invention shown in FIG. 1, use of such plates may best be imagined by visualizing ½ inch thick steel plates, having dimensions of 6 inches by 6 inches and a central 1-inch aperture for accommodating the tensioning members, resting at the passage entrances between the nuts (or other anchors for the tensioning members) and the modules.

In order to illustrate the various modules of the invention, their different features, and the different ways in which they may be combined and modified, each of the modules will now be discussed below in turn.

Module 100 includes a cast section 102 having a number of passages 104 extending through its length, and an insulating section 106 made of foamed polystyrene or other insulating material. While the insulating section 106 is shown in FIG. 1 on the outer wall of the foundation, it should be understood that it may alternatively or additionally be placed on the inside wall of module 100. To form module 100, the cast section 102 may be poured and cured and the insulating section 106 may simply be cut of insulating material to fit adjacent the cast section 102 in the manner shown in FIG. 1, with height/width dimensions corresponding to those of the cast section 102. However, it is often preferable to instead form the module 100 with the insulating section 106 being joined to the cast section 102 during the casting of cast section 102. This can be done, for example, by inserting nails or other fasteners through the insulating section 106 so that they protrude from one side of the insulating section 106, and then situating the insulating section 106 within the mold wherein the cast section 102 is being cast so that the fasteners protrude into the interior of the mold. This can be done, for example, by simply having the insulating section 106 form the bottom floor of the mold (with the fasteners protruding upwardly) and pouring concrete on top of it. When this procedure is followed, the cast section 102 and insulating sections 106 can be handled as an integral unit within module 100.

Optional drain tile cutouts 108 are shown at the bottom of module 100. The drain tile cutouts 108, which accommodate foundation drainage apparata, are simply formed by molding them into the cast section 102, and cutting them into the insulating section 106 either prior to or after the cast section 102 is poured and cured. It is notable that these drain tile cutouts 108 also provide an indentation wherein slings, hooks, etc. may be inserted, and they thereby make the module 100 easier to lift and lower into an excavated foundation hole by use of a crane or other lifting apparata.

As FIG. 1 illustrates, at the left end of module 100 at its upper side, a notch 110 extends through a portion of the height and width of the module 100. The notch 110 is intended to accommodate a support shim 2000, e.g., a steel bar, plate, or rod which extends from the notch 110 in the module 100 to a corresponding notch in an adjacent module. The support shim 2000 thereby forms a stiffening means which adds rigidity between abutting modules in addition to that provided by the tensioning members extending between the modules. During manufacture of the module 100, the notch 110 can be molded as a cavity into the cast section 102, or it can alternatively be formed by providing a piece of appropriately-shaped soft material protruding within the mold for the cast section 102. As an example, by inserting an appropriately-shaped piece of polystyrene insulation or multiple-ply corrugated cardboard within the mold for the cast section 102, this material will remain within the cast section 102 after it cures. The soft material can then be cut or scooped out by use of appropriate tools, or the strengthening shim 2000 can simply be pounded or otherwise inserted into the soft material (and thus within the module 100).

At the right-hand side of module 100, another stiffening means for adding rigidity between abutting modules is shown in the form of channel 2002. The channel 2002, which is preferably formed of steel, is sized and configured to closely receive the widths of adjacent module ends. Where stiffening means are desired for use between adjacent modules, the strengthening channel 2002 can be used instead of or in addition to the strengthening shim 2000.

Module 200 includes a cast section 202 wherein a number of passages 204 are situated, and a lintel 206 which is preferably embedded within the cast section 202 during casting. As an example, this arrangement may be provided by forming a mold wherein a lintel 206 formed of angle iron or metal plate protrudes into the bottom or top of the mold cavity during casting. When module 200 is installed within a foundation, bricks or the like may be installed on top of the lintel 206.

Module 300, which is formed in its entirety as a cast section, is situated at a corner of the foundation of FIG. 1. After the modules are installed, the tensioning members (not shown in FIG. 1) extend from the outside wall of module 300 to be tensioned and anchored. Rather than including tunnel-like passages for these tensioning members, as with the passages 104 and 204 in the modules 100 and 200, module 300 is provided with passages in the form of slots 302 formed across its width at the end of its length. Thus, module 300 is effectively provided with passages opening onto three sides of the module 300 rather than two sides (as with passages 104 and 204). The slots 302 are aligned along the axis of the passages 104 and 204 in adjacent modules 100 and 200 so that it may accommodate the same tensioning members as in those modules. The slots 302 are nevertheless sized and configured so that the aforementioned tensioning/anchoring means (plates, bolts, etc.) can still be used. In addition to the slots 204, module 300 also includes passages (not shown) for accommodating tensioning members extending through neighboring modules 400 and 500.

The opposing end of the module 300 is nonplanar between its inner and outer walls—more specifically, its end is staggered in two planes across its width—so that a protruding portion 304 is defined across its width. The module 300 is intended to be situated next to an adjacent module (in this case module 400) having an end configured to allow the modules to abut in complementary fashion. By providing complementary module ends which are nonplanar between their inner and outer walls, greater rigidity is provided at the juncture of the abutting modules. Additionally, this arrangement provides a longer path between the outer and inner walls (and greater surface area at the module ends whereupon sealants/adhesives may be applied), and this helps to prevent the travel of moisture from the outer walls to the inner walls.

Module 400 includes a cast section 402 having several passages 404 extending therein for tensioning members, and also includes several embedded beams 406 which form a studded interior wall within the building foundation. This arrangement is easily provided, for example, by inserting 2×6 wooden studs within the mold for the cast section 402 and then pouring concrete therein so that sections of the beams 406 protrude from the inner wall of the cast section 402, e.g., sections having size corresponding to standard 2×4 beams. As a result, the inner wall of module 400 is provided with beams effectively measuring 2×4 whereupon drywall or other paneling may be installed.

One end of the module 400 is staggered in two planes across its width to provide a protruding portion 408, thereby allowing module 400 to be placed in abutment with module 300 in complementary fashion. The opposite end of module 400 illustrates an alternate arrangement for providing interfitting abutment for modules by staggering the module end in two planes across both its width and its height, thereby providing two protruding portions 410 (only one of which is clearly visible in FIG. 1). It should be appreciated that once modules having such protruding portions 410 are placed in abutment, their inner and outer walls are restrained from removing out of a coplanar relation.

Module 500 includes a cast section 502 having several passages 504 extending through its length, and several furring strips 506 made of wood or other soft material are embedded adjacent the inner wall of module 500 (though these could alternatively or additionally be provided on the outer wall). Paneling may thereby be easily installed onto the furring strips 506 by affixing it thereto by means of nails or other fasteners. The furring strips 506 may be installed in the cast section 502 by providing them within the mold cavity at the time of casting the cast section 502.

At one end of the length of module 500, two protruding portions 508 are provided so that the module 500 may be placed in abutment with module 400 in close-fitting complementary fashion. The opposing end 510 is planar and is situated at a nonperpendicular angle with respect to the inner and outer walls of module 500 (in this case, at a 45° angle, though other angles could be used), and the adjacent module 600 has a similar configuration to allow modules 500 and 600 to be placed in complementary abutting relation. The use of this arrangement at the corner of the foundation provides somewhat greater rigidity between adjacent modules 500 and 600 than where abutting module ends are situated at angles perpendicular to their inner and outer walls (e.g., as between adjacent modules 200 and 300). This arrangement additionally provides greater surface area between the abutting ends of modules 500 and 600 to which sealants/adhesives can be applied, and provides a longer path between the inner and outer walls to deter the entry of moisture.

Module 600, which is formed in its entirety as a cast section having passages 602 extending through its length, is formed with a channel 604 extending along at least a portion of its outer wall. The channel 604 is configured to complementarily accept the width of another module (in this case one of stoop modules 1300, which will be discussed at greater length below). The channel 604 may be formed along all or a portion of the height of module 600, as well as all or a portion of its length. A passage 606 is then defined between the outer and inner walls of the module 600 and is situated within the channel 604 to allow tensioning of the module 600 with respect to modules resting within the channel 604.

A first end 608 of the module 600 is planar and is situated at a nonperpendicular angle with respect to the outer and inner walls so as to orient the module 600 at a desired angle when the first end 608 is placed in abutment with end 510 of module 500. More specifically, as illustrated in FIG. 1, the first end 608 is oriented at 45° with respect to the outer and inner walls of module 600 so as to orient the length of module 600 at a perpendicular angle with respect to the length of module 500.

A second end 610 of module 600 is configured similarly to the first end 608. Passages 612 may extend from the inner wall towards the outer wall at the second end 610, thereby allowing tensioning members to insert within the passages 612 to connect module 600 to module 700. These tensioning members can be used in addition to or instead of the tensioning members extending through passages 602.

Module 700, which is formed in its entirety as a cast section with passages 702 extending through its length, also includes a channel 704 on its outer wall for accommodating the insertion of other modules. It additionally includes an end which is staggered in different planes across its height to define a protruding portion 706. Module 700 may therefore be placed in abutment with a module having an end with complementary shape—in this case, module 800—and tensioning members may be installed along one or more generally vertically oriented passages 708 extending through the height of module 700 to vertically affix the modules together. Such vertical attachment can be used in addition to or instead of attaching module 700 to adjacent modules via tensioning members in its horizontally-oriented passages 702. In FIG. 1, the passages 702 and 708 are shown as being intersecting; naturally, if these passages are sized to barely accommodate tensioning members (e.g., where the passages 708 and 708 are sized to closely accommodate threaded rod), this arrangement will not allow simultaneous insertion of both horizontally-oriented and vertically-oriented tensioning members through passages 702 and 708. Therefore, it may in some circumstances be desirable to align the passages 702 and 708 in nonintersecting paths.

Module 800, which is formed in its entirety as a cast section with passages 802 extending through its length, is configured with opposing ends that are staggered in different planes across their heights to define protruding sections 804 and 806. Preferably, these planes are spaced by a distance corresponding to the width of the module 800. The protruding section 804 is configured to allow module 800 to mate with module 700 in complementary abutment, and includes one or more generally vertically-oriented passages 808 allowing tensioning members to pass from module 700 to module 800 to attach them together vertically. Likewise, the protruding section 806 is configured to allow module 800 to accommodate the width of module 900 in complementary abutment, and it includes one or more generally vertically-oriented passages 810 allowing tensioning members to pass from module 800 to module 900.

Module 900, which is situated at a corner of the foundation, is formed in its entirety as a cast section having passages 902 extending through its length. Module 900 has one end staggered in different planes across its height to define a protruding section 904. The planes are staggered by a distance which generally corresponds to the width of the module 800 so that when the protruding section 904 is placed over protruding section 806, the end of the protruding section 806 is approximately coplanar with the outer wall of the module 900 and the end of the protruding section 904 is approximately coplanar with the outer wall of the module 800. A generally vertically oriented passage 906 extends through the protruding section 904 so that tensioning members may extend through passages 810 and 906 to affix the modules 800 and 900 together vertically.

At its opposite end, the module 900 is staggered in two non-parallel planes across its width to define a notch-like, generally V-shaped indentation 908 wherein a complementary end of an adjacent module (in this case module 1000) may be received.

Module 1000 is also formed in its entirety as a cast section with passages 1002 extending through its length. The module 1000 includes one end which is staggered in non-parallel planes across its width to define a generally V-shaped protrusion 1004 sized and configured to be complementarily received within the indentation 908 of module 900. Its other end bears an indentation 1006 generally similar to the indentation 908 of module 900.

Module 1100 is formed in its entirety as a cast section, and since it is situated on a corner (similarly to modules 300, 500, 600, and 900) it includes passages 1102 extending through both its length and width dimensions so as to allow the passage of tensioning members into the modules 1000 and 1200 which it adjoins. One end of module 1100 includes a V-shaped protrusion 1104 similar to the protrusion 1004 on module 1000, thereby allowing module 1100 to abut module 1000 in complementary, close-fitting fashion. At the opposite end of module 1100, its width is slightly reduced to define a recess 1106 wherein the width of an adjacent module (in this case module 1200) may be received.

It is noted that in FIG. 1, the module 1100 is shown as having lesser length than other modules. This is done to illustrate that certain modules, particularly modules located at the corners of foundations, may be advantageously formed with reduced length and with special features to better enable them to provide a strong connection with adjacent modules. Two special features are particularly relevant:

First, it may be beneficial to provide reduced-length "adapter" modules to provide between other modules to provide a stronger, more water-tight connection therebetween. Consider that if module 1100 was missing, modules 1000 and 1200 could be joined by simply placing the end of one in abutment with the inner wall of the other (similarly to the arrangement shown between modules 200 and 300). However, this might not provide the desired degree of strength or water resistance. The module 1100 corrects for this by providing a complementary interfitting connection with its adjacent modules 1000 and 2000 at the corner of the foundation, rather than the relatively simple abutting relationship present between modules 200 and 300.

Second, since corner modules will often house tensioning members extending in various directions, they may be subject to higher compression stress than other modules. As a result, it may be beneficial to reinforce these modules by adding a metal internal skeleton, by longer curing after casting, or other conventional means of concrete reinforcement.

Module 1200 is somewhat similar to module 100 in that it includes a cast section 1202 wherein a number of passages 1204 are defined through its length, and it further includes an adjacent insulating section 1206. However, module 1200 also incorporates a protruding lower ledge 1208 within its cast section 1202, which is easily formed by appropriately configuring the mold wherein the module 1200 is cast. Module 1200 also includes a sill plate 1210, which is preferably made of treated lumber so that it may support untreated lumber members and prevent their contact with the cast section 1202. Both the insulating section 1206 and the sill plate 1210 can be firmly affixed to the cast section 1202 by extending nails or other fasteners through these components and wholly or partially within the mold for the cast section 1202, and then pouring the concrete within the mold about the fasteners to form the cast section 1202.

Modules 1300 and 1400 then illustrate modules appropriate for use as a stoop foundation. In current poured concrete foundations, stoop foundations are time-consuming and expensive to form because they are constructed using conventional concrete forms. Since conventional forms are 12 feet high and it is difficult to pour foundation walls having substantially lesser height, most stoop foundations extend as deeply into the ground as the remainder of the building foundation. This utilizes a significant amount of concrete and provides far greater foundational strength than is necessary. The stoop modules 1300 and 1400, being preformed prior to installation, need not be as deep as the rest of the foundation—for example, they can extend downwardly only four feet, rather than ten. Here, the side stoop modules 1300 are formed in their entireties as cast sections having insertion ends 1302 sized to rest within the channels 604 and 704 of the modules 600 and 700, and opposing stepped ends 1304 which have depressed tops to form protruding steps 1306. Passages 1308 extend lengthwise through the modules 1300 from their insertion ends 1302 to the stepped ends 1304, and vertical passages (not shown) extend through their heights at the steps 1306. The front stoop module 1400 is then sized and configured to be supported atop the steps 1306 of the modules 1300, and it includes passages 1402 which align with the passages 1308 (and also passages 1404 which align with the vertical passages in the modules 1300) when the front stoop module 1400 is installed on the side stoop modules 1300. The modules 1300 and 1400 may then be affixed to each other (and to the modules 600 and 700) by anchoring tensioning members within the passages 604 and 704 in modules 600 and 700, the passages 1308 in modules 1300, and the passages 1402 in module 1400. Module 1400 may also be anchored to modules 1300 by anchoring tensioning members within passages 1404 and through modules 1300. A stoop produced by the stoop members 1300 and 1400 is believed to provide strength which is at least equivalent to that of poured stoop foundations with far less cost.

Figure 2:
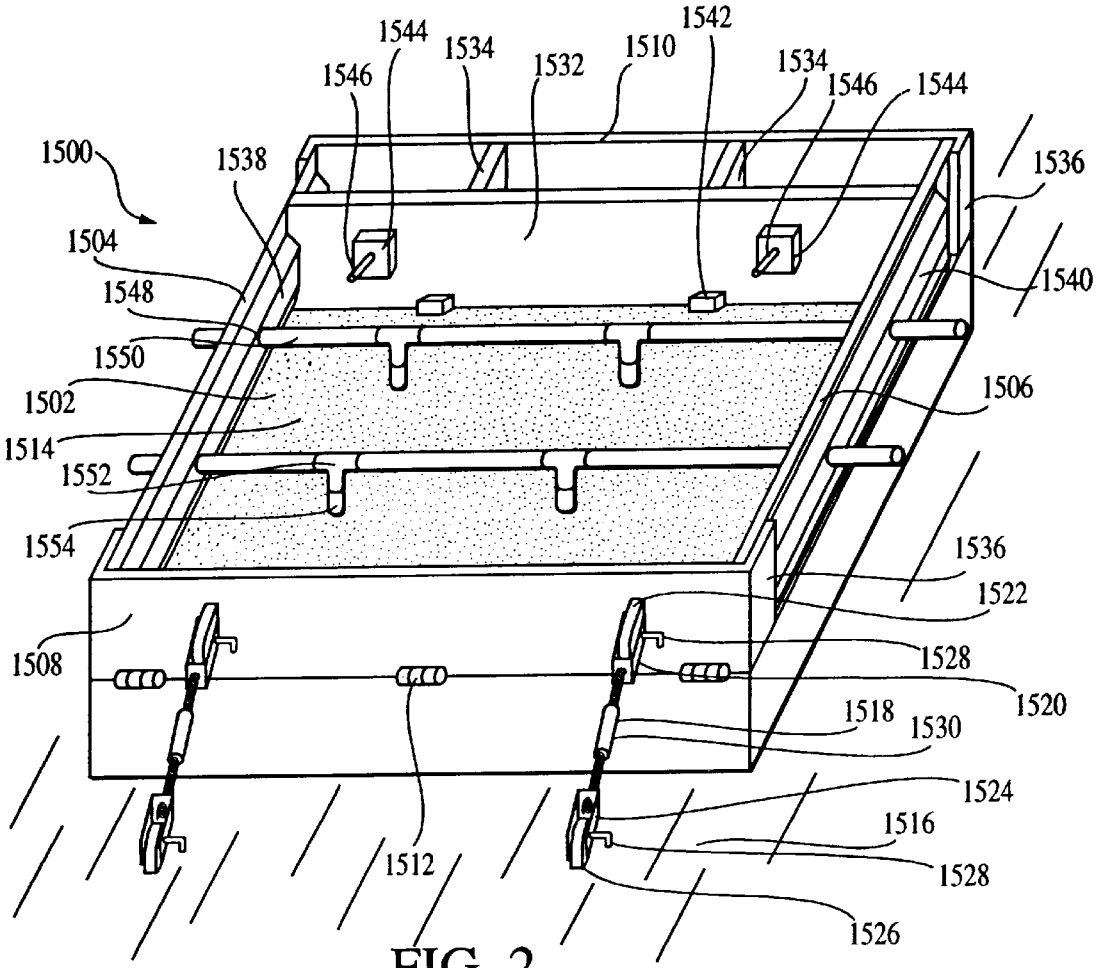
FIG. 2 is a perspective view of an exemplary mold used to form foundation modules in accordance with the invention.

Turning to FIG. 2, a particularly preferred method of manufacturing and installing modules will now be described with reference to an exemplary mold 1500 wherein modules may be cast. Within the mold 1500, a mold cavity 1502 is bounded by opposing mold cavity left and right walls 1504 and 1506 and opposing mold cavity bottom and top walls 1508 and 1510.

The mold cavity bottom and top walls 1508 and 1510 respectively correspond to the bottom and top sides of a module within the mold 1500, and are each affixed by hinges 1512 to a mold bed 1514 which is raised from the floor 1516. The mold cavity bottom and top walls 1508 and 1510 are prevented from swinging downwardly about the hinges 1512 by use of mold wall braces 1518, two of which are shown affixed to the mold cavity bottom wall 1508. The mold wall braces 1518 include a top clevis yoke 1520 pivotally affixed to a tongue 1522 protruding from the mold cavity bottom wall 1508 (with similar structure being used at the mold cavity top wall 1510, though this is not shown in FIG. 2). The mold wall braces 1518 also include a bottom clevis yoke 1524 pivotally affixed to a tongue 1526 extending from the floor 1516. The clevis yokes 1520 and 1524 are pivotally affixed to the tongues 1522 and 1526 via removable pins 1528. A threaded turnbuckle 1530 then extends between the clevis yokes 1520 and 1524 so that rotation of this turnbuckle 1530 adjusts the space on the clevis yokes 1520 and 1524, thereby adjusting the angle of the mold cavity bottom wall 1508 (and thus the angle of the bottom of the module with respect to its vertical faces).

An optional mold cavity ceiling 1532 is shown spaced from the mold cavity top wall 1508, it being noted that a mold cavity floor (not shown) having a similar configuration can be provided spaced from the bottom wall 1510. The mold cavity ceiling 1532 allows the mold 1500 to produce modules having different heights by varying the spacing of the mold cavity ceiling 1532 with respect to the mold cavity top wall 1508. Different spacing is attained by use of mold spacers 1534, which may be sized to provide the desired height within the mold cavity 1502.

The opposing ends of the mold cavity bottom and top walls 1508 and 1510 have protruding tongues 1536 which extend inwardly. These tongues 1536 thereby provide stops or attachment points for the mold cavity left and right walls 1504 and 1506, which are simply inserted into the mold cavity 1502 between the bottom and top mold cavity walls 1508 and 1510. Modules of different widths may be poured within the mold cavity 1502 by simply inserting spacers (not shown) between the tongues 1536 and the mold cavity left and right walls 1504 and 1506 to move one or both of these walls inwardly. When a mold cavity ceiling 1532 is used as in FIG. 2 (or a mold cavity floor having similar structure), it should be evident that moving the mold cavity left and right walls 1504 and 1506 inwardly will require a differently-sized mold cavity ceiling 1532 to be used.

Figure 3:
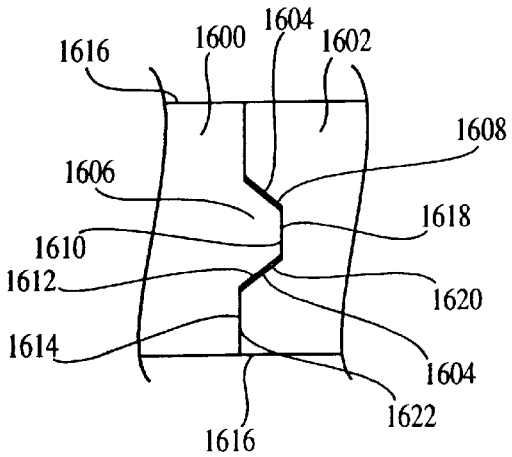
FIG. 3 is a partial top plan view of the ends of two adjacent concrete foundation modules illustrating a preferred configuration for the joints between the modules.

Looking particularly to the mold cavity left wall 1504 in FIG. 2, it is seen that a generally trapezoidal protrusion 1538 is formed along the length of the wall 1504 symmetrically about an axis situated halfway up the mold cavity left wall 1504. Similarly, the mold cavity right wall 1506 includes a generally trapezoidal indentation 1540 formed along the length of wall 1506 and situated symmetrically about an axis formed halfway up the mold cavity right wall 1506 (this indentation being seen from the rear of the mold cavity right wall 1506 in FIG. 2), this indentation 1540 being complementary to the protrusion 1538 on the mold cavity left wall 1504. This configuration of the mold cavity left and right walls 1504 and 1506 will, after concrete or other cementitious material has poured and set within the mold 1500, provide a module having a left end 1600 illustrated as in FIG. 3, with a corresponding right end 1602 (wherein FIG. 3 illustrates a partial sectional view of the joint provided by the mating ends of two modules produced with the mold 1500 of FIG. 2). The unique advantages provided by these types of joints will be discussed below.

Prior to pouring concrete within the mold cavity 1502 to cast a module, the mold 1500 preferably undergoes certain adaptations to assist in later removal and installation of the module. Initially, to adapt the mold cavity so that the module is more easily removed, small blocks 1542 made of wood, foamed polystyrene, corrugated cardboard, or another soft material are placed on the mold bed 1514 adjacent the mold cavity ceiling 1532 (or the mold cavity top wall 1504, if no mold cavity ceiling 1532 is present). Such blocks 1542 are also preferably placed on the mold bed 1514 adjacent the mold cavity bottom wall 1508 (or mold bed, if one is provided), though these blocks 1542 are not visible in FIG. 2. After the module is poured and set, the blocks 1542 are left embedded within the module, and may be quickly chipped out to allow notches for easier lifting of the module from the mold bed 1514 (e.g., by a forklift).

Additionally, the mold cavity 1502 is adapted to modify a cast module for easier installation. The mold cavity ceiling 1532 illustrated in FIG. 2 includes block-like pick point inserts 1544 (which are generally made of wood, foamed polystyrene, or another soft material) mounted halfway up its height. The pick point inserts 1544 are held on the mold cavity ceiling 1532 by threaded tubes 1546 which extend through the inserts and the mold cavity ceiling 1532. Later, when the poured and set module is removed from the mold 1500 and the mold cavity ceiling 1532, the pick point inserts 1544 and threaded tubes 1546 will be imbedded within the module. The pick point inserts 1544 can then be removed from the module by cutting or chipping them away, leaving an aperture about the threaded tubes 1546 so that a crane or other lifting equipment has ready access to the threaded tubes 1546 for easy attachment of a cable for lifting the module.

Further modifications are preferably made so that modules cast within the mold 1500 can be firmly and easily attached together by use of tensioning members. The mold cavity left and right walls 1504 and 1506 each bear apertures 1548 through which horizontal pipes 1550 are tightly fit, with the horizontal pipes 1550 protruding from the mold cavity left and right 1502 walls outside of the mold cavity 1502. The horizontal pipes 1550 are preferably made of plastic, such as polyvinyl chloride (PVC), and are preferably formed in short sections which are joined by connectors (e.g., the T-connectors 1552 shown in FIG. 2). It is noted that because the mold cavity wall apertures 1548 tightly accommodate the horizontal pipes 1550, it may be necessary to install the connectors 1552 on the horizontal pipes 1550 after the horizontal pipes 1550 are inserted within the mold cavity wall apertures 1548, since the mold cavity wall apertures 1548 may otherwise not be able to accommodate the T-connectors 1552. Once the horizontal pipes 1550 are fit within the mold cavity 1502, short vertical pipes 1554 are affixed to the T-connectors 1552 to extend downwardly to contact the mold cavity 1502 floor (which, if desired, could include shallow bores/holes therein for receiving the vertical pipes 1554). The vertical pipes 1554 help to support the horizontal pipes 1550 within the mold cavity 1502 and prevent them from sagging downwardly to produce less-than-straight passages for tensioning members. However, it is noted that sagging of the horizontal pipes 1550 can also be prevented by inserting a steel pipe, dowel, or other relatively rigid elongated member within the horizontal pipes 1550 to maintain them in a relatively straight orientation.

After the mold 1500 is configured as illustrated in FIG. 2, concrete is poured within the mold cavity 1502 to cast the module. Preferably, a relatively dry concrete mix is used; this is allowable possible because the module is being "horizontally poured" rather than within a vertical form, so flow problems that would occur within a vertical form when using a dry mix are not encountered. A dry mix is also helpful because it results in much stronger, denser concrete (as well as faster curing times). While the module will not fully cure overnight, it is nonetheless sufficiently strong within 12–18 hours that it may be removed from the mold 1500. When removing the module, one or more of the mold wall brace pins 1528 may be removed from the mold wall braces 1518, and the bottom and top mold cavity walls 1508 and 1510 may then be folded downwardly about the hinges 1512. The mold cavity left and right walls 1504 and 1506 may then be removed, as well as the mold cavity ceiling 1532 (if used). The module will then be left sitting on the mold bed 1514, and the blocks 1542 may be cut or chiseled out to provide slots which allow the module to be more easily tipped upwardly (as by a forklift) for removal from the mold 1500. As noted above, the module may then be readily lifted by a small crane which engages the threaded tubes 1546. The horizontal pipes 1550 will then have formed tensioning member passages extending through the length of the module at its center, with bores formed within the module by the vertical pipes 1554. These bores extend outwardly from the passages to the inner or outer wall surfaces.

Figure 4:
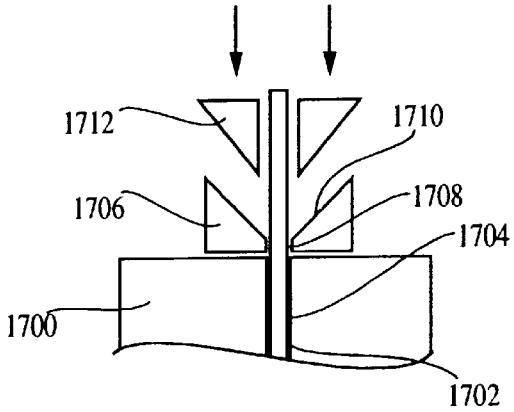
FIG. 4 is a partial sectional side elevational view of an anchoring arrangement for tensioning members extending within modules.

After modules are formed, they may be installed within a foundation hole. The aforementioned tensioning members can be installed to firmly affix the modules together. If threaded rods are used as the tensioning members, bolts can simply be installed at the ends of the rods to tension them with respect to the modules. Preferably, large washers (e.g., perforated plates) are situated between the bolts and the modules to provide a greater bearing surface against the modules. If cables, non-threaded rods, or the like are used, a preferred means of anchoring the cables after tensioning is illustrated in FIG. 4. In FIG. 4, the end of a module 1700 is illustrated with a cable 1702 extending through a passage 1704 in the module 1700. The cable 1702 extends first through the passage 1704 and then through an aperture 1708 in the bearing plate 1706. The bearing plate 1706 also bears a conical valley 1710 adjacent the aperture 1708. Two or more wedge members 1712 are then provided, and these are shaped to fit within the conical valley 1710 in such a manner that when the cable 1702 is tensioned and the wedge members 1712 are inserted within the valley 1710, and the cable 1702 is then released, the wedge members 1712 will be pulled into the valley 1710 to firmly bear against both the bearing plate 1706 (which in turn bears against the module 1700) and the cable 1702. Thus, the wedge members 1712 anchor the cable 1702 at its ends to maintain tension in the cable 1702.

As previously noted, the bores formed by the vertical pipes 1554 extend through the interiors of the modules to open upon the passages wherein the tensioning members rest. These bores are preferably provided because after the tensioning members are tensioned, concrete, cementitious grout, or similar hard-setting materials can be pumped into the bores to flood the passages about the tensioning members. When the filler material dries, the tensioning members will be effectively affixed within the passages at all points along their lengths, rather than just at their ends. This approach avoids the possible loss of tension in a tensioning member if bolts, wedge members, or other anchors at the ends of the tensioning members should give way (as might happen, e.g., if such an anchor was not adequately protected against rusting when buried in the ground). This approach also maintains tension in the tensioning member in the event an owner later cuts into the foundation walls and severs a tensioning member. It has been found that the aforementioned modules can provide a foundation which is vastly stronger than a conventional vertically-poured foundation if seven-strand metal cable (tensioned to 18,000–36,000 pounds) is used as a tensioning member with the aforementioned wedge members, and grout is pumped into the passages and allowed to set.

Once all modules have been installed and tensioned together in the foregoing manner, further measures can be taken to protect the foundation from possible entry of water. Water entry is primarily prevented by applying caulk or grout in the joints formed between abutting modules, and this is generally sufficient to prevent entry of water. However, in some cases it may be desirable to have further protection, e.g., in areas where the water table is so low that water may stand against the foundation. At the exterior surface of the foundation, joints can be sealed with grout, caulk, or other hard or soft sealants. A petroleum-based sealant can then be applied over that sealant to protect it. On the inside wall, joints can simply be caulked to provide a smooth surface.

It is noted that the joints between abutting modules do not need to have perfectly mating surfaces in order to provide protection against water entry; in fact, it is believed to be helpful if the joints provide a vertical channel extending along the height of the wall to allow water to flow downwardly within the joints. This is exemplified by the joint arrangement illustrated in FIG. 3, wherein the joint between two adjacent modules 1600 and 1602 is intentionally left with a space 1604 formed between the modules so as to form a vertical channel running through the height of the wall. In this arrangement, any water flowing from the exterior of the foundation through a joint will encounter the void/channel 1604. The water will then flow downwardly to the bottom of the foundation and into the drain tile (or other drainage system) rather than flowing further inward. In effect, these joints serve as a vertical drainage system within the foundation, which complements the horizontal drainage system situated at the bottom of the foundation. It should be understood that the joint configuration illustrated in FIG. 3 is not the only type of joint which provides a vertical channel 1604 between adjacent modules, and many other joint configurations are possible which provide the same effect. However, the joint configuration of FIG. 3, wherein a protruding trapezoidal section 1606 located generally centrally in one module is received within a complementary trapezoidal recess 1608 located generally centrally in the adjacent module, is particularly preferred. In this arrangement, the trapezoidal protrusion 1606 has a terminal end 1610 between opposing sides 1612 which slope inwardly from a pair of lands 1614 to the terminal end 1610, with the lands 1614 extending between the opposing sides 1616 of the module 1600. The trapezoidal recess 1608 is shaped to receive the trapezoidal protrusion 1606 with its floor 1618 abutting the terminal end 1610 of the trapezoidal protrusion 1606, and with its sides 1620 spaced from the sides 1612 of the trapezoidal protrusion 1606 to provide the vertical channels 1604. Lands 1622 then extend from the recess sides 1620 to the opposing sides 1616 of the module 1602. The joint provides a lengthy entry path between the opposing module sides 1616, thereby deterring the entry of water. This joint additionally provides large, flat bearing surfaces between the modules (between the protrusion's terminal end 1610 and the recess floor 1618, and also between the lands 1614 and lands 1622 of the modules), which helps to support large tensioning loads in the tensioning members without cracking or crushing of the modules near the joints. Further, since the protrusion 1606 is received within the recess 1608, the joint is also resistant to the shifting of modules out of alignment.

The description set out above is merely of one exemplary preferred embodiment of the invention, and it is contemplated that numerous additions and modifications can be made. Following are additional examples. It is understood that these examples are not to be construed as describing the only additions and modifications to the invention, and that the true scope of the invention is defined by the claims set forth at the end of this document.

First, it should be understood that in practice, the invention would probably rarely use the wide variety of different module features noted above. Instead, it is likely that a single construction project would use several similar modules, e.g., several modules having similar configurations for complementary interfitting connection to adjacent modules, similar insulation features, similar embedded structures such as lintels/beams/furring strips, etc. FIG. 1 merely illustrates a wide variety of these features within a single foundation for the purpose of illustrating different possible features of the invention and the different ways in which they may be combined. Naturally, the various features described as being present in a particular module above are for the most part suitable for use in other modules; as examples, the notch 110/shim 2000, the insulating section 106, the drain tile cutouts 108, etc. of the module 100 can be installed for use in any other module, the lintel 206 of the module 200 can be installed for use in any other module, etc.

Second, it should be understood that the description given above and the accompanying drawing do not describe the only configurations for the modules and the only features which the modules may contain. As examples, it should be apparent that a wide variety of complementary connection configurations between modules are possible apart from those described as being present between the adjacent modules above. More complex patterns may be provided across one or more of the dimensions of the modules to provide an interlocking fit with adjacent modules; for example, one module may have an end formed in a sawtooth shape, and an adjacent module may have a complementary sawtooth shape to allow a complementary interfitting connection between the modules. In addition, the complementary connections may arise from structures which are not formed within the cast sections of the modules; for example, metal members embedded within the cast sections and protruding therefrom might extend from one module so that they can be received within apertures formed in the end of an adjacent module. As a further example, where the passages extending through the lengths of the modules are formed by embedded tubes, one module may have its tubes protrude from one of its ends to be received within larger tubes forming the passages of the adjacent module. In this manner, the tubes will provide an interfitting connection between modules as well as providing passages for tensioning members. A wide variety of other features present in common construction projects, e.g., plumbing, electrical conduits, heating elements, etc. can be embedded within modules so that they are available for later use without significant installation measures. Features such as door and window frames, overhangs, ledges, steps, etc. can also be formed into the modules, most beneficially by directly forming them within the cast sections during casting.

Third, it is noted that some of the features described above as being affixed to the cast sections of the modules—e.g., the insulating section 106, the beams 406, the sill plate 1210, etc.—can also be added to the cast sections after these are poured and cured. In this event, the cast sections might be formed with protruding fasteners, and the insulating sections, studs, sill plates, etc. can then be affixed to these protruding fasteners.

Fourth, similarly to the forming of poured concrete foundations, it may sometimes be desirable to install the various modules atop pre-poured concrete footings in an excavation hole. However, such footings may be rendered unnecessary where the modules have footings integrally formed therein, such as the one effectively provided by the lower ledge 1208 in module 1200. As an alternative, rather than supporting the modules atop poured footings, they may be placed atop pea gravel or similar materials which are capable of supporting significant weight without substantial settling. Placing the modules atop "footings" formed of gravel or other porous soil-like materials is also advantageous in that these enhance desirable drainage in the soil around the building foundation. Of course, it should be understood that it may be acceptable to install modules with no footings at all; the question of whether footings are required will primarily depend on the soil conditions and building codes applicable at the construction site.

Fifth, it was noted above that the abutting ends of a module at a joint can be provided with complementary mating surfaces, thereby preventing the modules from shifting out of a coplanar relationship. Such joints were described as being formed, for example, by the use of complementary structures on the mold cavity left and right walls 1504 and 1506 during casting. It is also possible to form mating joints on the tops and bottoms of modules so that modules can be vertically stacked to form an upwardly-extending wall. Such joints can be formed by the addition of appropriate structure to the mold cavity ceiling 1532 and/or mold cavity floor, or on the mold cavity top and bottom walls 1508 and 1510. In other words, it should be understood that the structures and methods described herein for constructing a wall made of a horizontal array of modules can also be extended to the construction of a wall made of a vertical array of modules.

What is claimed is:

1. A building comprising wall modules horizontally arrayed end-to-end in series, thereby forming a continuous vertical wall, each module including:

a. opposing inner and outer wall surfaces extending between its ends, and wherein the ends of each module include:

(1) a first end including a vertically elongated protrusion having opposing sides with a terminal end therebetween, the sides being spaced from the inner and outer wall surfaces, with lands extending from the sides to the inner and outer wall surfaces;

(2) a second end including a vertically elongated recess having opposing sides with a floor situated therebetween, the sides being spaced from the inner and outer wall surfaces, with lands extending from the sides to the inner and outer wall surfaces;

wherein each recess is configured to receive a protrusion therein with a substantially complementary fit;

b. a passage defined therein, the passage being surrounded by passage walls; and c. a tensioning member extending through the module's passage, the tensioning member being bonded to at least a substantial portion of the passage walls of the module, wherein the tensioning member extends through the passages of at least two adjacent modules to maintain them in side-by-side relationship;

wherein the ends of two of the modules, when fit together to form the joint, define a vertically elongated channel extending through at least a substantial portion of the joint.

2. The building of claim 1 wherein the tensioning member is one of:

a. a threaded rod, or b. a cable.

3. The building of claim 1:

wherein the passages within each module extend between the module's ends;

wherein each module includes opposing inner and outer wall surfaces extending between its ends, with a bore extending from at least one of the inner or outer wall surfaces to open upon the passage; and wherein adhesive is supplied to the bores of the modules to fill the passages of the modules about the tensioning members, thereby affixing the tensioning members within the passages.

4. The building of claim 1 wherein the ends of two of the modules, when fit together to form a joint with the first end of one of the modules having its protrusion received within the recess of the second end of the other module, have:

a. the lands of the first end abut the lands of the second end, and b. the terminal end of the protrusion abut the floor of the recess.

5. The building of claim 1 wherein the vertically elongated channel is defined between the protrusion and the recess.

6. The building of claim 1 wherein the wall modules at least partially surround a floor, the floor being situated between the inner surfaces of the wall members and being at least substantially horizontally oriented.

7. A building comprising a row of at least three adjacent wall modules arrayed to form a vertical wall, each module including an interior passage surrounded by passage walls, wherein a tensioning member extends through the passages of the wall modules in a state of tension, the tensioning member being affixed to the passage walls within the passage of each wall module, whereby severing the tensioning member between any adjacent pair of wall modules will not eliminate the tension in the tensioning member between other adjacent pairs of wall modules;

wherein the interior passage within each module extends between passage openings at opposing sides of the module, and wherein each module includes a bore extending from a bore opening on the surface of the module to open upon the interior passage, the bore opening being separate from the passage openings, whereby adhesive is inserted into the bore opening to fill the interior passage about the tensioning member.

8. The building of claim 7 wherein the tensioning member is affixed within the passage of each wall module by bonding it to at least a substantial portion of the passage walls of each passage.

9. The building of claim 7 wherein:

each module includes opposing ends with opposing inner and outer wall surfaces extending therebetween, each of the modules includes one end configured to receive one end of another of the modules in substantially complementary fashion to form a joint, and each joint includes a vertically elongated channel defined therein, whereby water entering the joint will encounter the channel and flow vertically downward through the channel.

10. The building of claim 9 wherein the opposing ends of the modules include:

a. a first end having an elongated protrusion defined by opposing protrusion sides with a protrusion terminal end therebetween, the protrusion sides being spaced from the inner and outer wall surfaces, with lands extending from the protrusion sides to the inner and outer wall surfaces, and wherein the protrusion sides and protrusion terminal end are oriented along an at least substantially vertically oriented plane;

b. a second end having an elongated recess defined by opposing recess sides with a recess floor situated therebetween, the recess sides being spaced from the inner and outer wall surfaces, with lands extending from the recess sides to the inner and outer wall surfaces, and wherein the recess sides and recess floor are oriented along an at least substantially vertically oriented plane.

11. The building of claim 7 wherein the adjacent wall modules are horizontally arrayed to define the vertical wall.

12. A building comprising:

a. at least two wall modules, each wall module including:

(1) opposing ends with opposing inner and outer wall surfaces extending therebetween, at least one of the ends abutting the end of an adjacent one of the wall modules to form a joint between the modules;

(2) an interior passage extending between its opposing ends;

(3) a bore extending through at least one of its inner and outer wall surfaces to open upon its interior passage;

b. a tensioning member extending through the interior passages of the wall modules and affixing them together, wherein adhesive is supplied to the bores of the modules to fill the passages of the modules about the tensioning members, thereby affixing the tensioning members within the passages.

13. The building of claim 12 wherein each joint includes a vertically elongated channel formed therein, the channel extending across at least a substantial portion of the ends of the wall modules forming the joint.

14. The building of claim 12 wherein the abutting module ends forming a joint include:

a. a first end on one of the modules, the first end including an elongated protrusion extending across at least a substantial portion of the joint;

b. a second end on another one of the modules, the second end including an elongated recess extending across at least a substantial portion of the joint, wherein the recess is configured to receive the protrusion therein in substantially complementary fashion.

15. The building of claim 14 wherein:

the first end includes lands on opposing sides of the protrusion, the lands extending between the protrusion and the inner and outer wall surfaces of the one module;

the second end includes lands on opposing sides of the recess, the lands extending from the protrusion and the inner and outer wall surfaces of the other module;

the lands on the first end abut the lands on the second end; and the protrusion has a flat terminal end and the recess has a flat floor, with the terminal end abutting the floor.

16. The building of claim 15 wherein the joint includes at least one elongated channel situated between the protrusion and the recess.

17. The building of claim 12 wherein the wall modules are horizontally arrayed in end-to-end abutment to define a vertical wall.

18. The building of claim 14 wherein the protrusion and recess are each oriented in an at least substantially vertical plane.

19. A building comprising wall modules horizontally arrayed end-to-end in series, thereby forming a continuous vertical wall, each module including:

a. opposing inner and outer wall surfaces extending between its ends, and wherein the ends of each module include:

(1) a first end including a vertically elongated protrusion having opposing sides with a terminal end therebetween, the sides being spaced from the inner and outer wall surfaces, with lands extending from the sides to the inner and outer wall surfaces;

(2) a second end including a vertically elongated recess having opposing sides with a floor situated therebetween, the sides being spaced from the inner and outer wall surfaces, with lands extending from the sides to the inner and outer wall surfaces;

wherein each recess is configured to receive a protrusion therein with a substantially complementary fit;

b. a passage defined therein, the passage being surrounded by passage walls; and c. a tensioning member extending through the module's passage, the tensioning member being bonded to at least a substantial portion of the passage walls of the module, wherein the tensioning member extends through the passages of at least two adjacent modules to maintain them in side-by-side relationship;

wherein the passages within each module extend between the module's ends;

wherein each module includes opposing inner and outer wall surfaces extending between it ends, with a bore extending from at least one of the inner or outer wall surfaces to open upon the passage; and wherein adhesive is supplied to the bores of the modules to fill the passages of the modules about the tensioning members, thereby affixing the tensioning members within the passages.

* * * * *